United States Patent [19]

Robinson et al.

[11] Patent Number: 4,606,775

[45] Date of Patent: Aug. 19, 1986

[54] AUTOMATIC DISHWASHER IN A DUAL FUNCTIONING SYSTEM

[75] Inventors: Ronald A. Robinson, Garden Grove; William J. Boan, Westminster; George D. Evans, Tustin, all of Calif.

[73] Assignee: Purex Corporation, Lakewood, Calif.

[21] Appl. No.: 597,025

[22] Filed: Apr. 5, 1984

[51] Int. Cl.[4] ..... B08B 7/04

[52] U.S. Cl. ..... 134/18; 134/25.2; 206/219; 220/23; 252/90; 252/92

[58] Field of Search ..... 134/25.2, 18; 252/90, 252/92; 220/20, 23; 206/219

[56] References Cited

U.S. PATENT DOCUMENTS

| | | | |
|---|---|---|---|
| 1,609,447 | 12/1926 | Ward . | |
| 2,321,998 | 6/1943 | Crouch et al. . | |
| 2,385,648 | 9/1945 | Prager . | |
| 2,629,508 | 2/1953 | Prager | 220/23 X |
| 2,671,037 | 3/1954 | Stoddard | 134/25.2 |
| 3,306,858 | 2/1967 | Oberle | 252/99 |
| 3,406,695 | 10/1968 | Perl | 134/58 |
| 3,893,607 | 7/1975 | Jones | 220/23 X |
| 4,123,375 | 10/1978 | Altenschopfer et al. | 252/99 |
| 4,253,842 | 3/1981 | Ehrlich | 252/92 X |
| 4,286,016 | 8/1981 | Dimond et al. | 252/90 |
| 4,418,819 | 12/1983 | Shapiro | 220/23 X |
| 4,460,490 | 7/1984 | Barford et al. | 252/92 |
| 4,563,186 | 1/1986 | Flynn et al. | 252/90 |

FOREIGN PATENT DOCUMENTS

| | | |
|---|---|---|
| 2552506 | 5/1977 | Fed. Rep. of Germany . |
| 2742683 | 3/1978 | Fed. Rep. of Germany . |
| 2820318 | 11/1978 | Fed. Rep. of Germany . |
| 1368126 | 12/1964 | France . |
| 1584410 | 2/1981 | United Kingdom . |
| 1599245 | 9/1981 | United Kingdom . |

*Primary Examiner*—Peter Hruskoci
*Attorney, Agent, or Firm*—William W. Haefliger

[57] ABSTRACT

The method of washing articles in an automatic dishwasher includes the steps:

(a) providing a first volume of a first treating component for use in the dishwasher, (b) providing a second volume of a second treating component in close transported association with the first volume, but isolated therefrom, for presentation at the time of use of said first component, (c) one of said first and second components consisting essentially of nonionic surfactant, and the other of said first and second components consisting essentially of chlorine release agent, and (d) separating some of said second component from said close association with the first component and employing same in the dishwasher at the time of adding said first component to the dishwasher.

8 Claims, 19 Drawing Figures

AUTOMATIC DISHWASHER IN A DUAL FUNCTIONING SYSTEM

BACKGROUND OF THE INVENTION

This invention relates to a system that provides convenient consumer use of automatic dishwasher detergent, and includes unique packaging to provide better performance, longer shelf life, easy determination of the product, and accurate dispensing of the use levels. The system employes packaging of the active ingredients for optimum efficiency and stability.

Automatic dishwasher detergents are formulated to remove soil (stains) from glasses, dishes, flatware, pots, pans, and some plastic ware. These compounds, that are designed for dishwashers, generate low suds, minimize (1) spotting and filming, (2) ceramic etching, and (3) metal corrosion.

Nonionic detergents are used that are especially compounded to have low foam and good soil removal properties at the normal dishwash water temperatures. Chlorine release agents are used to bleach stains, sanitize, and reduce hazing and spotting of glassware. Various phosphates are added to control alkalinity, peptize soils, and soften water. Silicates are added to inhibit corrosion and protect the china finish. Other ingredients are often used to add to alkalinity and aid in water softening (carbonates and sequesterants). Fillers may also be used to adjust the use strengths of the formulas. Coloring agents and/or perfumes are usually added for aesthetic appeal.

The above listed ingredients must be combined in such manner as to provide stability of the active ingredients, proper density for the package size and use levels, homogeniety for uniform performance, resistance to caking, good flow characteristics, and adequate aesthetics.

SUMMARY OF THE INVENTION

The performance quality of automatic dishwasher detergent can be directly related to the resultant spotting and filming of glassware. The amounts of nonionic and available chlorine in the formula affect the degree of spotting and filming, however, the nonionic tends to cause poor chlorine stability. Techniques that can be used to minimize this effect are to use more chlorine-resistant nonionics, to lower levels of nonionics, to isolate the chlorine containing compounds by encapsulation, to absorb the nonionic on some dry medium, and to provide selective agglomeration; however, these techniques are not altogether satisfactory, and do not permit selective control by the ultimate user of amount of chlorine release agent in relation to nonionic, so as to obtain best results on different types of dishes, glassware, etc. to be washed.

The present invention has as its major object the isolation of the chlorine release agent and the nonionic surfactant, one from the other, in the bulk of the detergent formula composition, and in such manner that chlorine stability is not diminished as during storage prior to use, and also enabling the ultimate user to vary the relative proportions of these two ingredients in their dishwasher use, to obtain best results. Basically, the invention is embodied in the provision of a highly advantageous, unitary, automatic dishwasher detergent package comprising in combination:

(a) a first openable container containing a first component for use in an automatic dishwasher, (b) a dispensing container containing a second component, and forming a fitment, (c) the fitment carried by the first container to be readily detachable at least in part for dispensing the second component to be used in the dishwasher, (d) one of said first and second components consisting essentially of nonionic surfactant, and the other of said first and second components consisting essentially of chlorine release agent.

For most applications, the greatest benefit is realized when the available chlorine compound is placed into the fitment is that the available chlorine is isolated from the nonionic in the detergent composition, and its proportions can be easily varied. The compound can be tableted, encapsulated, packeted, or be in granulated form to be placed, for example, into a metering fitment or tube. The recommended level of material, or varied level for better control, can then be added to the dishwasher dispenser zone, from the fitment. Optionally, the nonionic may be placed in the fitment to provide its isolation from the chlorinated compounds in the bulk of the composition. The addition of the nonionic from a fitment has the further advantage of reducing filming and spotting by allowing immediate availability to the wash water.

In its method of use aspects, the invention basically contemplates the following steps:

(a) providing a first volume of a first treating component for use in the dishwasher, (b) providing a second volume of a second treating component in close transported association with the first volume, but isolated therefrom, for presentation at the time of use of said first component, (c) one of said first and second components consisting essentially of nonionic surfactant, and the other of said first and second components consisting essentially of chlorine release agent, and (d) separating some of said second component from said close association with the first component, and employing same in the dishwasher at the time of adding said first component to the dishwasher.

These and other objects and advantages of the invention, as well as the details of an illustrative embodiment, will be more fully understood from the following description and drawing, in which:

DRAWING DESCRIPTION

DETAILED DESCRIPTION

Figure 1:
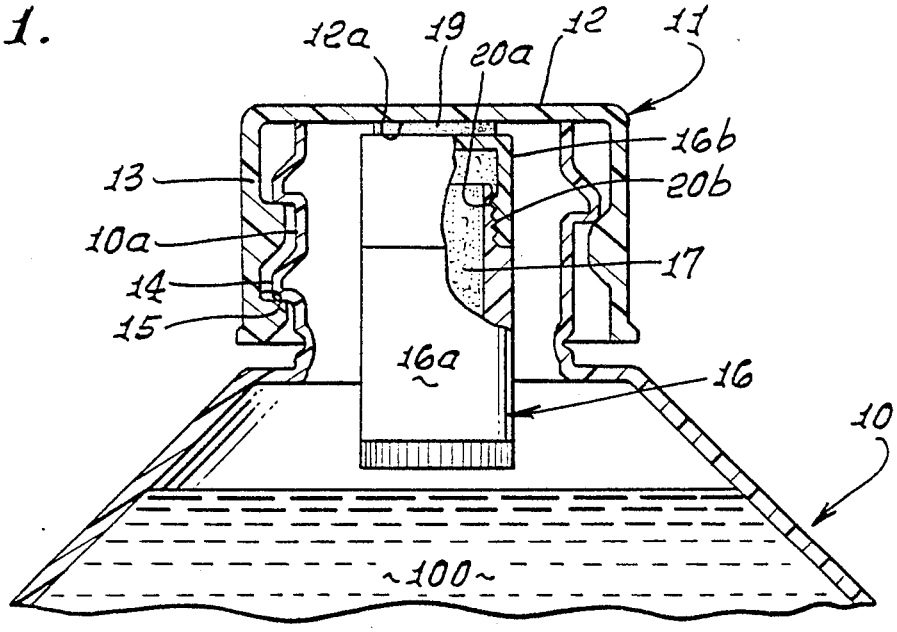
FIG. 1 is a vertical section showing a fitment adhered to the underside of a bottle overcap.

Referring first to the drawings, FIG. 1 illustrates a first container in the form of a bottle 10 having a threaded neck 10*a*, the bottle containing flowable component 100 (as for example flowable dry detergent composition). The bottle has a removable cap 11 which in turn has a top horizontal wall 12 overlying the neck 10*a*, and a depending skirt 13 that extends an interfitting section with the neck. As shown, the skirt and neck have interfitting screw threads 14 and 15, other type connections being usable. The bottle, neck and cap may all consist of usable plastic material.

Also provided is a dispensing container as defined by fitment 16 containing a second component 17 in flowable granule, tablet or other form. The fitment is indirectly carried by the bottle 10, and directly by the cap 11, to be readily detachable at least in part, for dispensing the second component (nonionic or chlorine release agent) as at the time of charging the automatic dishwasher. Thus, for example, removal of the cap 11 to provide access to the first component immediately presents the user with the fitment projecting from the removed cap, reminding the user that the fitment is ready to be used for application of second component for the dishwasher, as at the precise time of use of the first component and in conjunction therewith, to obtain a resulting higher quality automatic washing of dishes and other articles (due to the selection of relative amounts of the two components, and non-degradation of the chlorine release agent).

As shown, the fitment has a sub-container 16*a* and a sub-container cap 16*b*, the latter being retained by the top wall 12, and specifically to its underside 12*a* as by means of adhesive, double tape, VELCRO stripping, or other means, each of which is represented by the layer 19. In use, the sub-container 16*a* may be removed from the cap, as by reverse rotation to unscrew threads 20*a* and 20*b*. The component carried by sub-container 16*a* is then exposed for use, for example, pouring into a measured volume of first component added to the dishwasher (for example to a dispensing chamber in the door of the machine).

The dispensing device itself can be made from plastic, glass, metal or other suitable material for holding liquid or a solid.

The dry bleach container 10 can be made from any suitable material including polyethylene, polypropylene, PVC and other plastics, glass, metal, or paperboard. In the case of paperboard, a suitable moisture barrier would be advantageous to maintain the product's effectiveness during storage and use.

Figure 2:
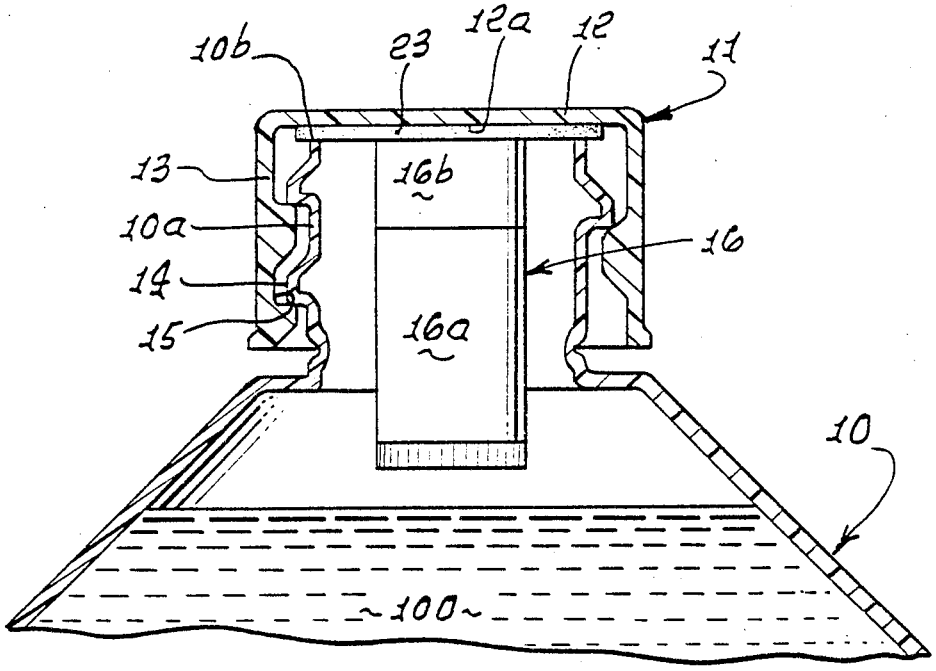
FIG. 2 is a vertical section showing a fitment cap seated on the bottle finish.

In FIG. 2, the elements bearing the same numbers as in FIG. 1 are the same. The fitment cap 16*b* in addition has a radially projecting flange 23 extending over the rim 10*b* of the bottle neck 10*a* and retained on that rim by the underside 12*a* of the bottle cap 11. Thus, the fitment 16 is completely detachable from the cap 11 when the bottle is removed from the neck 10*a*.

Figure 3:
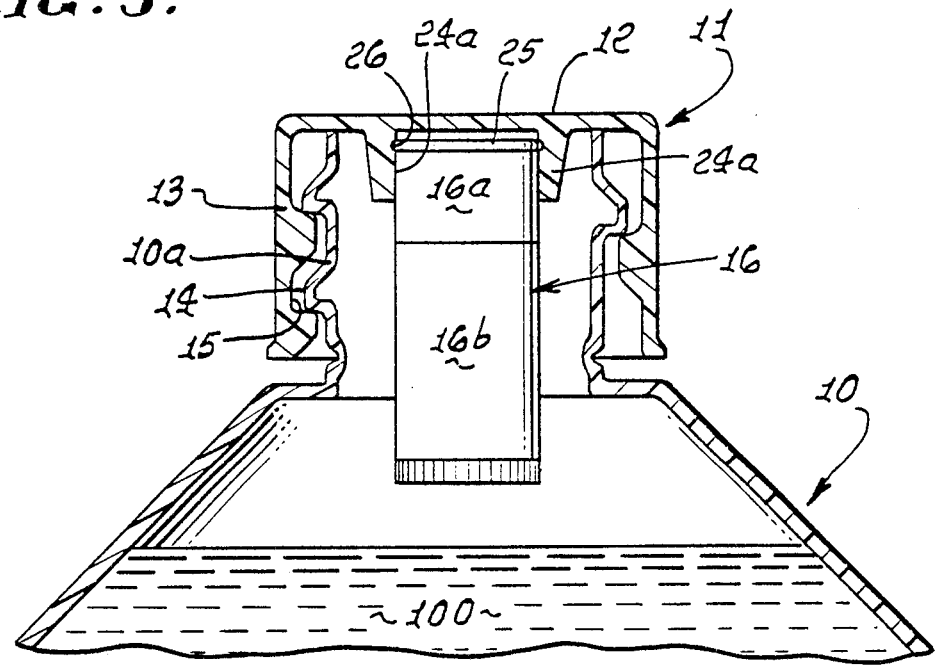
FIG. 3 is a section showing a fitment cap snapped into a friction sleeve in a bottle overcap.

In FIG. 3, the elements bearing the same numbers as in FIG. 1 are the same. The cap top wall 12 in addition has an integral sleeve 24*b* depending therefrom, within the bottle neck. The fitment cap 16*b* may extend telescopically into the sleeve bore 24*a*, and a flange 25 on the cap may removably snap into an annular recess 26 in the bore wall, as shown.

Figure 4:
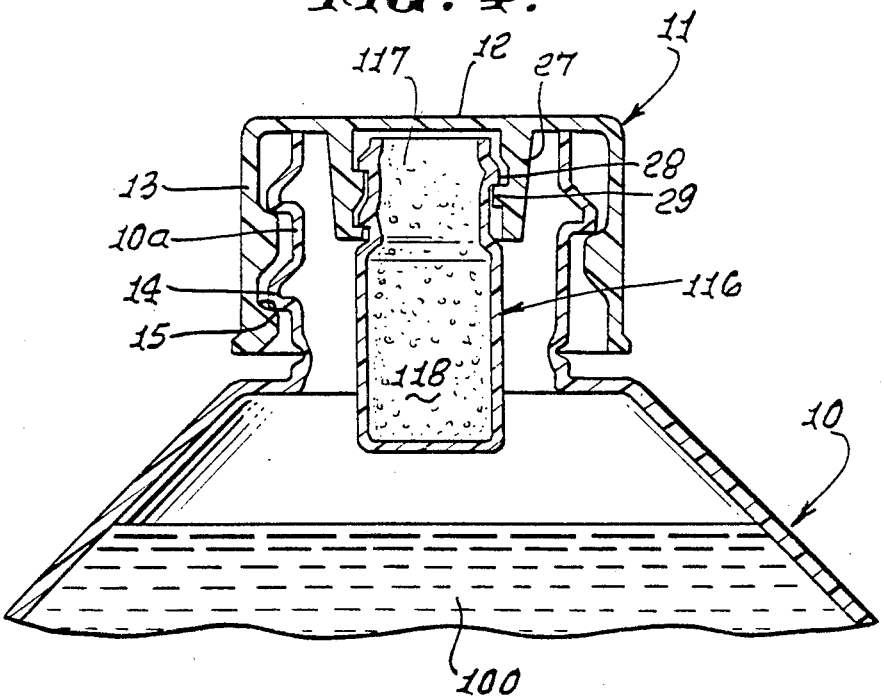
FIG. 4 is a section showing a fitment cap threaded into a sleeve in a bottle over cap.
Figure 13:
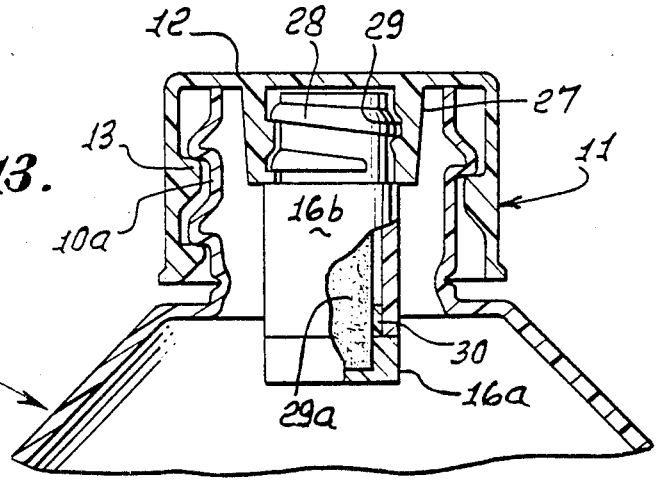
FIG. 13 is a section showing an inverted fitment thread connected into a double threaded overcap.

In FIG. 13, the elements bearing the same numbers as in FIG. 1 are the same. The cap top wall 12 in addition has an integral sleeve 27 depending therefrom, within the bottle neck. The fitment sub-container 16*b* in this embodiment has threaded connection with the sleeve 27, as afforded by threads 28 and 29. The fitment sub-container cap 16*a* is thus presented to the user. He may detach the cap 16*a* and pour activator 29*a* from the sub-container 16*b*. Both cap and sub-container frictionally interfit at 30, other methods of connection being usable. FIG. 4 is like FIG. 13 except the fitment 116 is in one piece and has an open top at 117, directly below wall 12. Fitment thread 28 engages sleeve thread 29. Component granules in the fitment appear at 118. Component tablets may be used.

Figure 15:
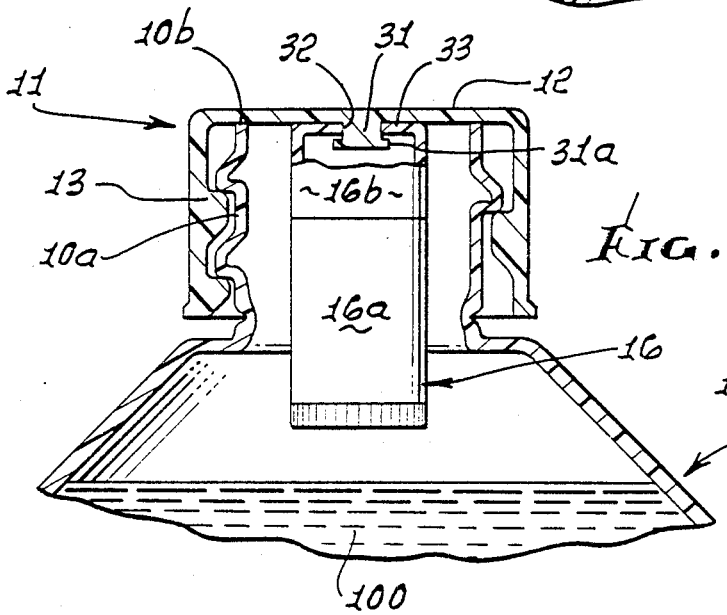
FIG. 15 is a section showing a fitment snap connected onto a plug in the bottle overcap.

In FIG. 15, the elements bearing the same numerals as in FIG. 1 are the same. The fitment cap 16*b* and the bottle cap top wall 12 include removably interfitting snap connection elements, as for example small flanged boss or plug 31 depending from top wall 12 and received through an opening 32 in the fitment cap top wall 33. Opening 32 is slightly smaller in diameter than the flange 31*a*, providing a snap-on interfit. Other forms of snap connection are usable.

Figure 12:
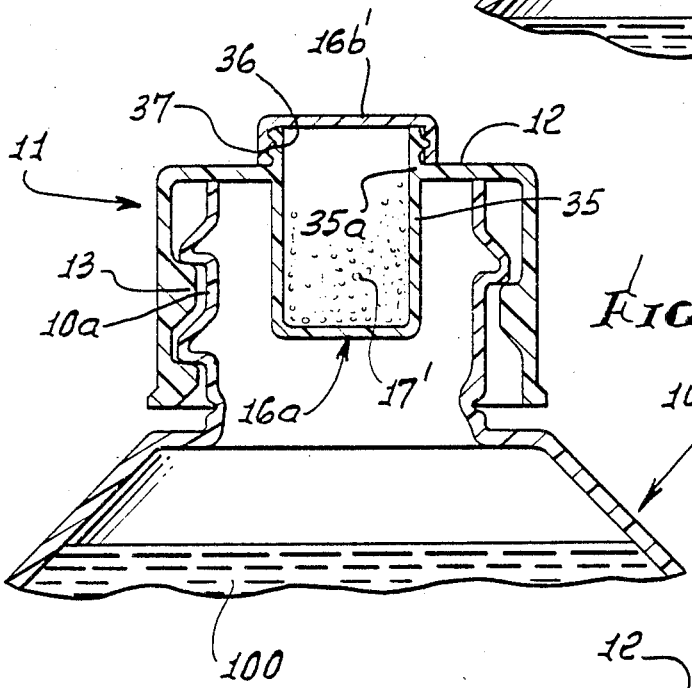
FIG. 12 is a section showing a fitment molded as an integral part of a bottle overcap.

In FIG. 12, the elements bearing the same numerals as in FIG. 1 are the same. The fitment sub-container 16*a* has a side wall 35 integrally molded with the bottle cap top wall 12, at 35*a*, and wall 35 projects and is externally threaded at the upper exterior side of the wall 12. Sub-container cap 16*b*' is internally threaded at 36 to engage the external thread 37 on wall 35, as shown. Thus, cap 16*b*' is easily removable, exteriorly, to allow pouring or other dispensing of the component 17' which may consist of flowable granules, or may be in other form.

Figure 11:
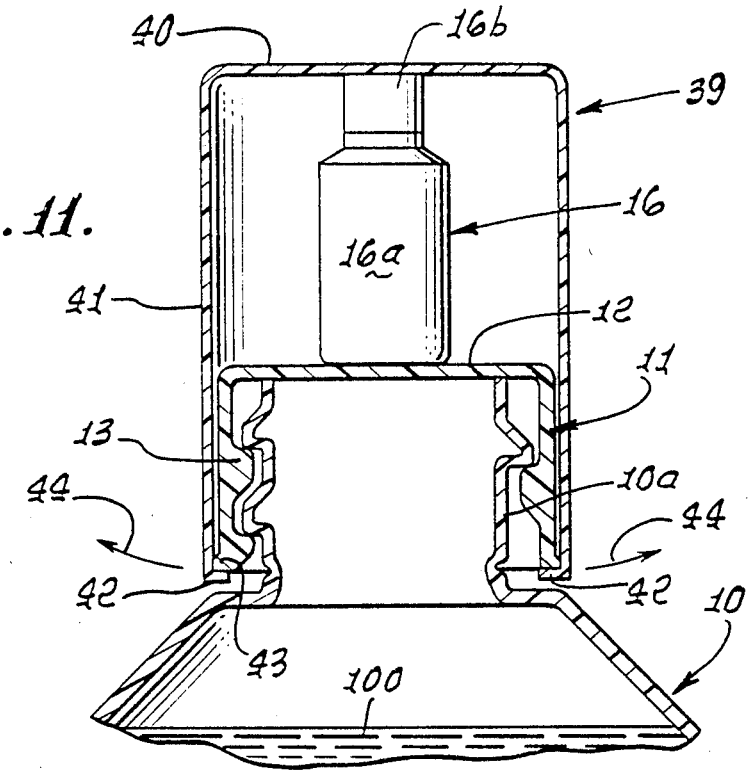
FIG. 11 is a section showing a fitment contained in a bottle snap-on overcap.

In FIG. 11, the fitment 16 is primarily (as for example completely) located outside and above the cap top wall 12, and auxiliary means is provided to retain the fitment in position, just above wall 12. In the example, such auxiliary means has the form of a thin-walled plastic overcap 39, having a top wall 40 located to compressively retain the fitment vertically between walls 40 and 12, as shown. The overcap depending skirt 41 is removably mounted on the bottle cap, so that it may be easily detached. As shown, two lips 42 engage the lower rim 43 of the cap 11, and may be pulled free (see arrows 44) to release the overcap, providing access to the fitment 16.

Figure 14:
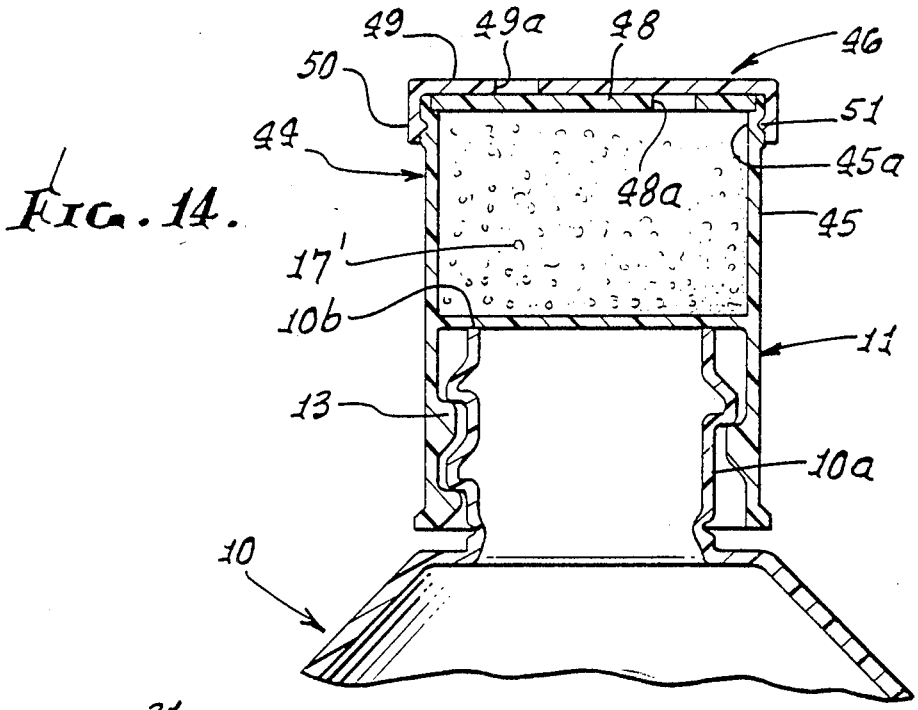
FIG. 14 is a section showing a fitment thread connected over the bottle finish, the fitment having a cap attached to a rotary dispensing closure.

In FIG. 14, the fitment 44 includes a sub-container 45 integral with the bottle cap 11, and extending thereabove. Sub-container cap structure 46 is connected to the sub-container 45, to allow dispensing of the flowable composition. As shown, the cap structure includes first and second walls 48 and 49, each containing ports 48*a* and 49*a* normally out of registration. The walls extend adjacent one another, and are relatively rotatable (i.e. wall 49 may rotate relative to wall 48, for example) to bring ports 48*a* and 49*a* into registration, allowing dispensing of the contents. Wall 49 is shown as having a skirt 50 with annular detent connection at 51 to the sub-container wall 45*a*, allowing rotation of the skirt and wall 49. Flowable granules are indicated at 17'.

Figure 5:
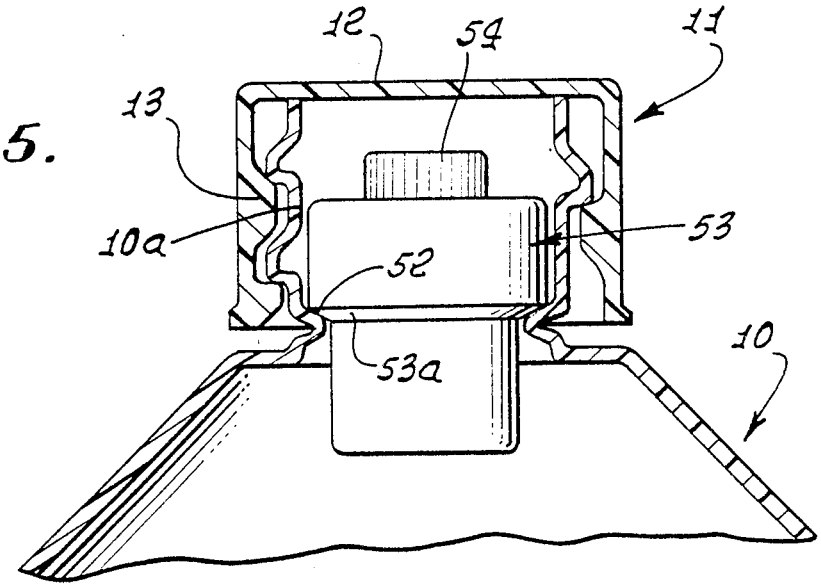
FIG. 5 is a section showing a fitment flange engaging an indent on a bottle neck.
Figure 6:
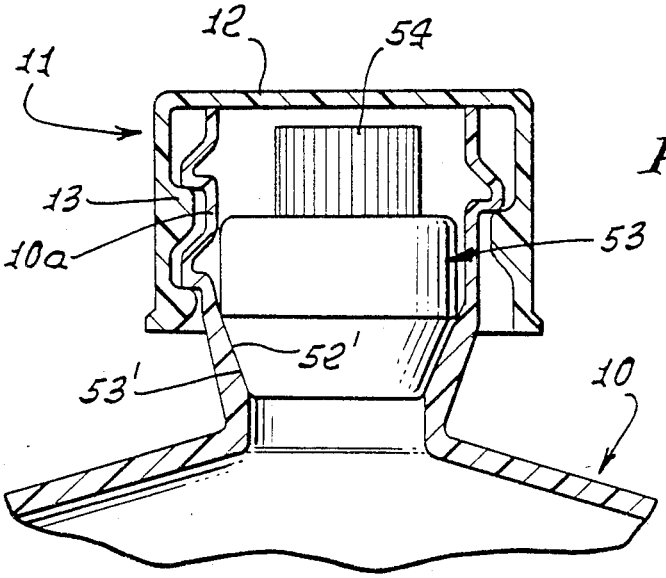
FIG. 6 is a section showing a tapered fitment wedged into a bottle tapered neck.

In FIG. 5, the bottle neck 10*a* has an internal ledge or ledges 52 seating the fitment sub-container 53. The latter has a flanged undersurface 53*a* engaging the ledge, which may be annular. In FIG. 6, the modified ledge 52' tapers downwardly, and cooperatively engages or seats the frusto-conical outer surface 53' of the fitment sub-container 53, to position the fitment. Caps for the fitment sub-container appear at 54 in FIGS. 5 and 6, and the fitments are loosely contained within the bottle neck to be completely removable when the bottle cap 11 is removed.

Figure 9:
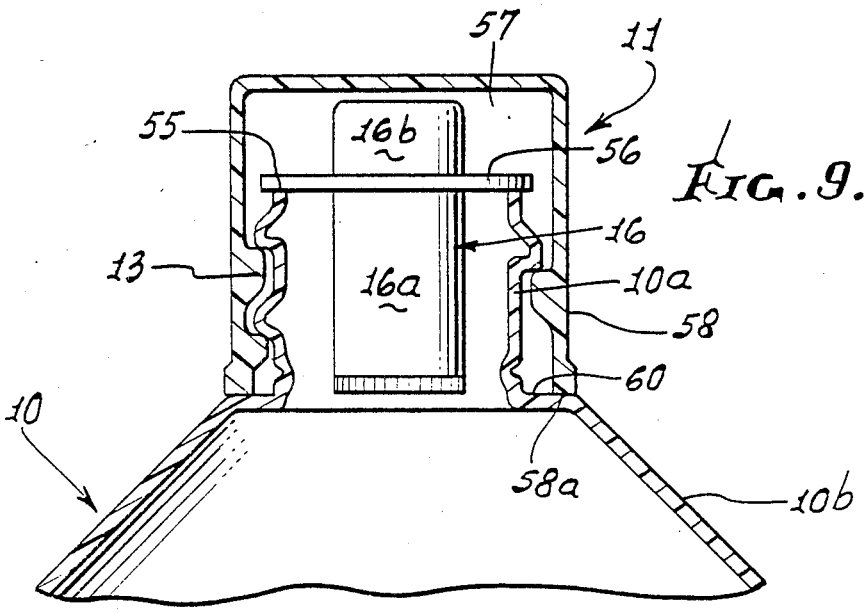
FIG. 9 is a section showing a collar under a fitment cap engaging a bottle sealing surface, and the bottle cap sealing on a bottle shoulder.
Figure 10:
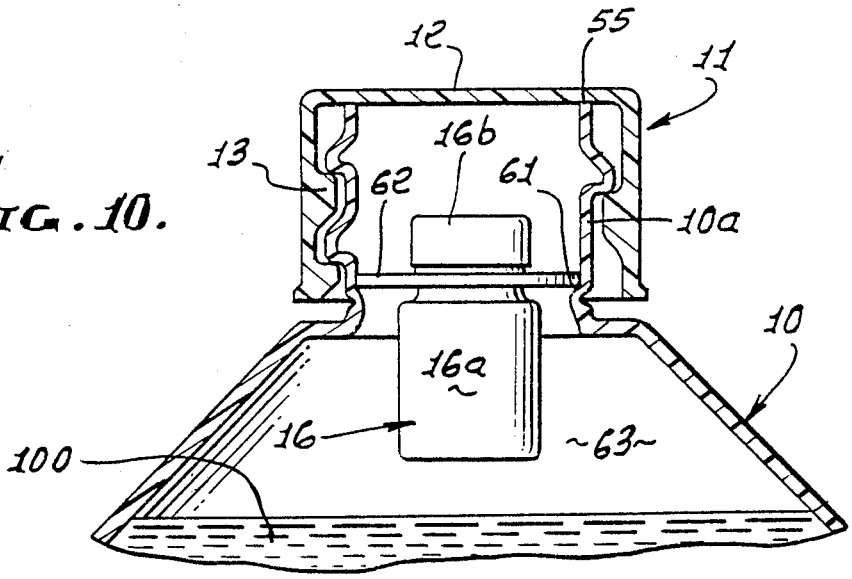
FIG. 10 is a section showing a collar under a fitment cap engaging an indent on a bottle neck.

In FIG. 9, the bottle neck 10*a* has an upper rim 55, and an external flange 56 on the fitment 16 seats on that rim to retain the fitment sub-container 16*a* within the neck 10*a*, and the sub-container cap 16*b* projecting upwardly within the cap upper interior 57. The lower edge or rim 58*a* of the cap skirt 58 seats and seals against the bottle shoulder 60 between neck 10*a* and bottle wall taper 10*b*. In FIG. 10, the bottle neck 10*a* has an internal integral flange or shoulder 61; and an external flange 62 on the fitment 16 seats on that flange 61. The flange is annular, and the fitment sub-container 16*a* projects downwardly through the flange into the bottle upper interior 63. Top wall 12 of cap 11 seats and seals on the upper rim 55 of the neck 10*a*.

Figure 8:
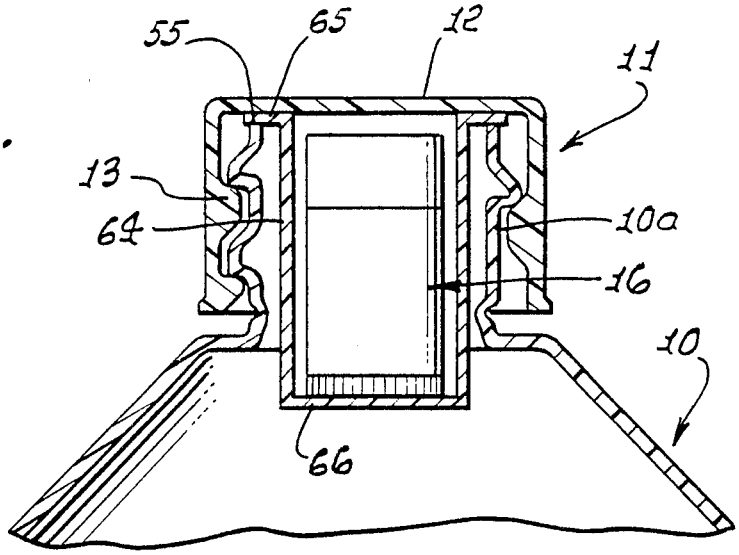
FIG. 8 is a section showing an inner container seated inside a flanged cup fitment which engages the top of the bottle finish.

In FIG. 8 a receptacle 64 has an external flange 65 seating on the bottle neck rim, and retained in position by the top wall 12 of the cap 11. The upwardly opening receptacle extends downwardly within the bottle neck 10*a*, and fitment 16 is loosely received in the receptacle, and confined between bottom wall 66 of the receptacle and top wall 12. Receptacle 64 is removable after cap 11 is removed.

Figure 7:
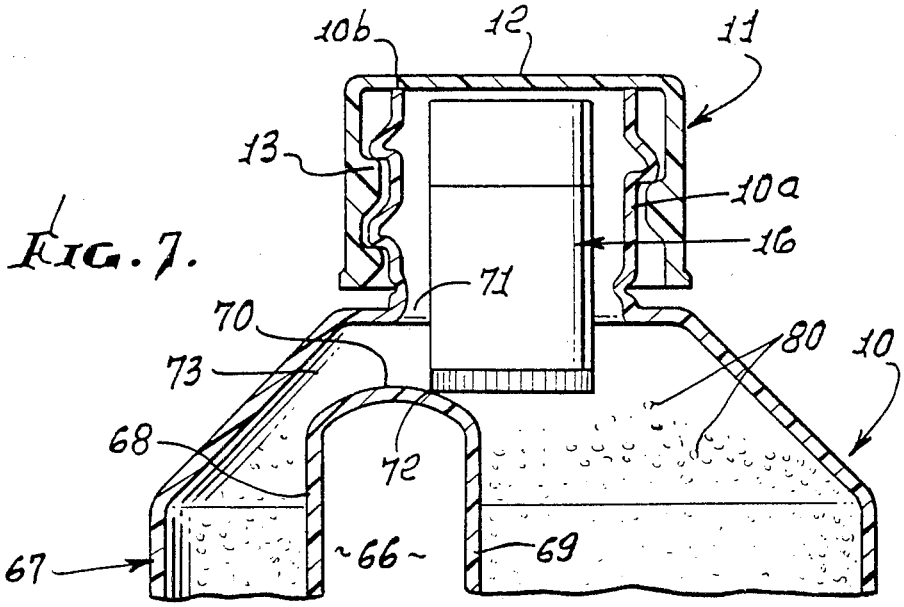
FIG. 7 is a section showing a fitment seated on a shelf formed in the bottle, as an indent or part of the bottle handle.
Figure 16:
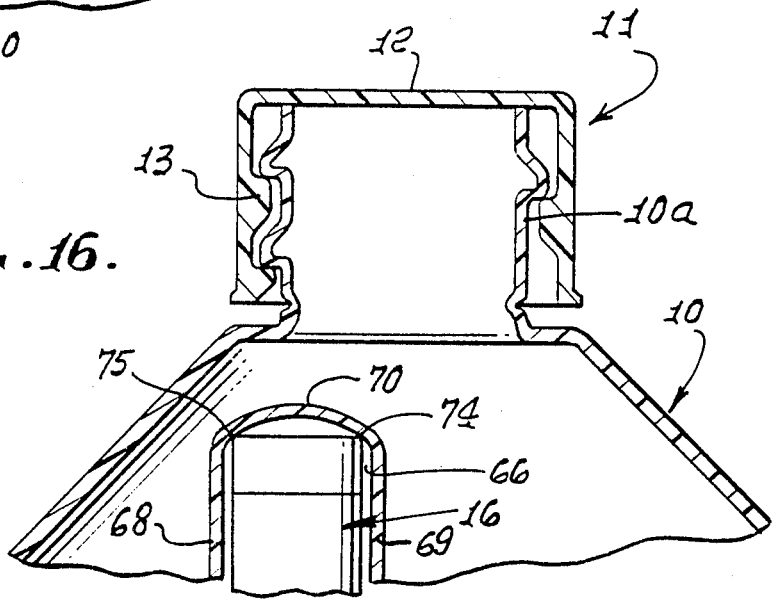
FIG. 16 is a section showing a fitment received within a recess formed in the bottle as an indent or handle.

In FIG. 7, the bottle 10 has side wall structure that forms a lateral hand reception opening 66 and a manually graspable handle 67 associated with that opening. The wall structure includes vertical walls 68 and 69, and wall upper portion 70 presented internally of the bottle and generally upwardly toward neck 10*a* and neck opening 71. The fitment 16 is seated at 72 on wall upper portion 70, within upper interior 73 of the bottle, and also extends upwardly into and within the neck opening 71, as shown. The fitment may be sufficiently large in diameter so as to be retained in position by the neck and by the wall portion 70. The opening 66 may be merely an indent, and other than associated with a handle. See also flowable granules at 80, filling the bottle. In FIG. 16, the fitment 16 is received within the opening or indent 66, removably retained as by frictional engagement with the wall structure, as at points 74 and 75.

Figure 17:
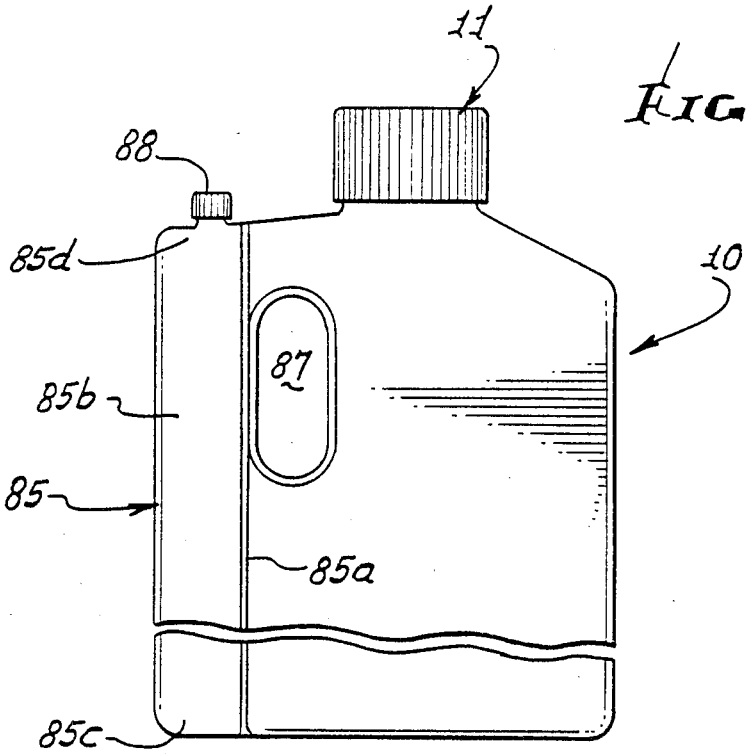
FIG. 17 is a vertical elevation showing a fitment molded as an integral part of a bottle, thereby forming a dual chambered container.

In FIG. 17, the fitment 85 extends externally of the bottle 10 and is attached thereto, as per example at the vertical location 85*a*, merging with the bottle side wall. Thus, the vertically elongated fitment may include a portion 85*b* forming a bottle handle associated with lateral opening 87 through the bottle for finger reception. The fitment is shown to extend upwardly from a location 85*c* near the bottom of the bottle to a location 85*d* near the top of the bottle. Fitment cap 88 is exposed externally of the bottle and its cap 11, and is offset laterally from cap 11, so that if cap 88 is removed, the flowable second component contents of the fitment container can be poured into the dishwasher, or into granules of first component to be added to the machine, and if cap 88 is replaced and cap 11 removed, the first component granules can be poured into the machine.

Figure 18:
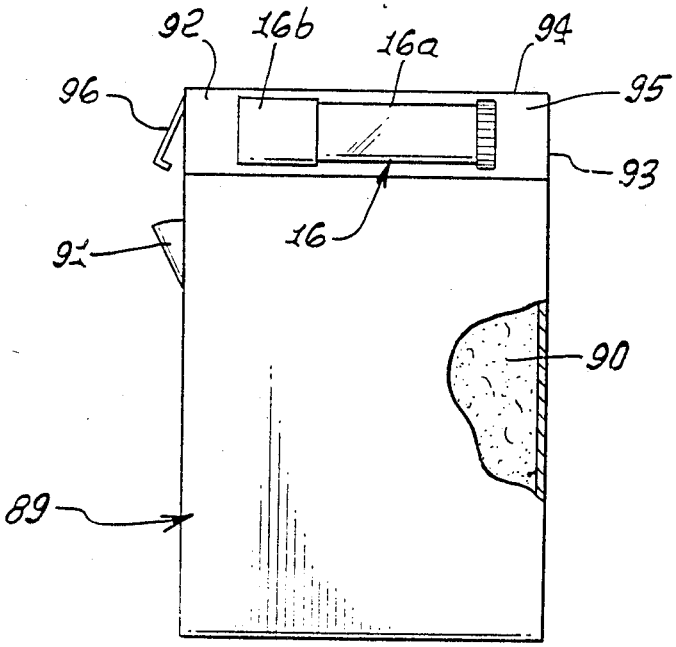
FIG. 18 is a vertical elevation, partly in section, showing a fitment contained in a separate compartment that is an integral part of a folding carton used to hold the nonionic or chlorine release agent.

In FIG. 18, the carton 89 (as for example cardboard) contains detergent such as dry granules seen at 90. A pour spout appears at 91. The fitment 16 is carried in a separate compartment 92 defined by the carton, as for example by carton walls 93–95 at the top of the carton. A flap 96 is releasable to allow fitment removal.

Other possible ways of achieving the fitment using a carton are:

(1) Twin cartons attached face-to-face, top-to-bottom, or side-to-side using glue, double-sided tape, or Velcro strip.
(2) Twin cartons banded together with tape, pressure sensitive sticker, shrink wrap plastic, foil or paper overwrap, or a plastic sleeve.
(3) Twin cartons in an open-end paperboard sleeve, two-pack carrier or tray.
(4) A single carton containing two plastic bags.
(5) A single carton with a domed plastic overcap containing the activator.

Other fitment designs are possible, and it is not intended that this invention be limited to the specific designs described in these figures.

The source of available chlorine is commonly supplied by chlorinated trisodium phosphate, sodium or potassium dichlorocyanurate, and trichloroisocyanuric acid. Other compounds that find some application are 1,3 dichloro-5,5 dimethylhydantoin, N,N'-dichlorobenzoylene urea, N-dichlorobinuret, sodium, calcium, or lithium hypochlorite. The use level commonly is between 0.5% and 3% as available chlorine.

The nonionics (surfactants) are commonly used at about 1% to 8% by weight (of the formula) levels with 2%–4% being more common. They are very low foamers. The composition of nonionics are not as easy to describe as the available chlorine compounds because they are mixtures of organic compounds of similar structure with a distribution of molecular weights in both the hydrophylic portion of the molecule. Some examples are:

a. The condensation of 1 mole of saturated or unsaturated, straight, or branched chain, alcohol or fatty acid containing about 10–20 carbon atoms with from about 4 to 50 moles of ethylene oxide.
b. Polyethylene glycols having a molecular weight of about 1,400 to 30,000.
c. The condensation of 1 mole of alkylphenol (8–18 carbons in alkyl chain) with from 4 to 50 moles of ethylene oxide.
d. Polyoxypropylene, polyoxyethylene condensates which are sold under the trade name of PLURONICS by BASF.

e. Compounds like (a) that are "capped" with propylene oxide, butylene oxide and/or short chain alcohols and/or fatty acids (carbon chains of 1–5). BASF's PLURAFAC RA series are this type of compound.

The silicates are commonly used at from about 5% to 30% as the sodium or potassium silicate. These silicates are glassey compounds composed of $SiO_2$ and $M_2O$ (M=Na or K) in ratios of from about 1:1 to 1:3.2 as $M_2O:S_iO_2$. The more commonly used ratios are 1:2 and 1:2.4.

The detergent builder portion of the formula usually is described as that portion that contains the water softeners, peptizers, and alkalinity buffers. Common ingredients are sodium or potassium tripoly phosphate (10% to 50%) or pyrophosphate (10–50%) or orthophosphate (5%–30%) or carbonate (0–40%) or organopolycarboxylate (0%–30%).

Other ingredients are added to improve performance or aesthetics. They would include antifoams of the distearyl acid phosphates and silicone types at 0.05% to 0.2% by weight (of the formula) level to protect the finish or fine china aluminosilicates and aluminates are used at 0.5% to 0.2%. Perfume and color are added as required for aesthetic reasons. The selection of perfume and color is greatly expanded when the available chlorine is removed to the fitment. It is common for chlorine release compounds to bleach coloring compounds. They can also perfume to change their odor to an undesirable note.

Fillers that are commonly used are sodium or potassium chloride, sodium or potassium sulfate, sucrose and sucrose esters. They usually are present at 0%–30%. (Wt.% of formula).

The following are two typical automatic dishwasher formulations, wherein the nonionic and chlorine release agent are together in the mix, whereby instability of the chlorine release agent exists. Amounts shown are weight percents.

| | Dry mixed | Agglomerated |
|---|---|---|
| Sodium tripolyphosphate, partly hydrated % | 39.0 | — |
| Sodium tripolyphosphate, anhydrous | — | 35.0 |
| Sodium silicate, granules | 9.0 | — |
| Sodium silicate, liquid | — | 16.0 |
| Sodium carbonate | 20.0 | 20.0 |
| Sodium chloride | 10.0 | 10.0 |
| Sodium sulfate | q.s. | q.s. |
| Potassium dichlorocyanurate | 1.5* | 1.5 |

*Equivalent to 0.87% Available Chlorine

Instability as a function of amount of nonionic percent by weight, is shown as follows (after one month at 100° F.):

| | | | | | |
|---|---|---|---|---|---|
| Dry Mixed | | | | | |
| % nonionic | 0 | 0.5 | 1.0 | 1.5 | 2.0 |
| % available chlorine | 0.55 | 0.32 | 0.16 | 0.05 | 0 |
| Agglomerated | | | | | |
| % nonionic | 0 | 0.5 | 1.0 | 1.5 | 2.0 |
| % available chlorine | 0.75 | 0.61 | 0.42 | 0.35 | 0.23 |

The following formulas are useful in the present invention:

AUTODISH DETERGENTS WITH FITMENTS FOR IMPPROVED STABILITY

| | I | II |
|---|---|---|
| Detergent phase | | |
| Sodium tripolyphosphate % | 47 | 47 |
| Sodium carbonate | 20 | 20 |
| Sodium sulfate | q.s. | q.s. |
| Sodium dichlorocyanurate | 1.6 | — |
| Sodium silicate | 10.0 | 10.0 |
| Nonionic | — | 1.5 |
| Water | 10.0 | 10.0 |
| Fitment phase | | |
| Nonionic | 1.5 | — |
| Sodium dichlorocyanurate | — | 1.6 |

In the above, the available chlorine stability is found to be as follows:

| | Dry Mix | Agglomerated |
|---|---|---|
| Available chlorine stability % after 1 month at 100° F. | 0.70 | 0.82 |

Figure 19:
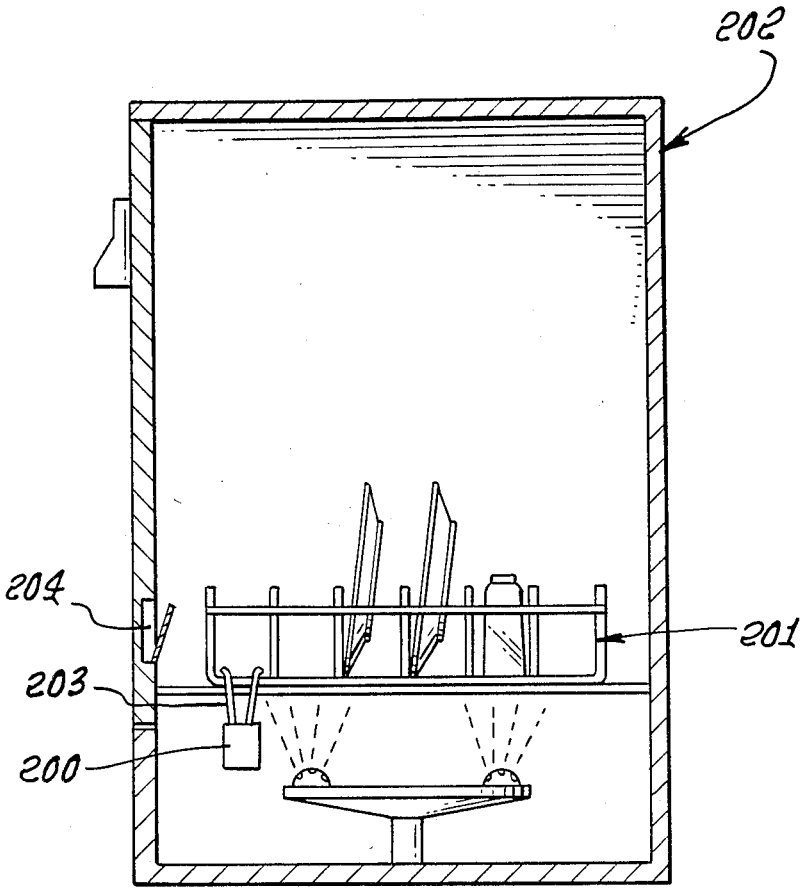
FIG. 19 shows use of a fitment in an automatic dishwasher.

The invention also contemplates employment of the fitment itself removed from the main container, as a rinse aid, in an automatic dishwasher. See, for example, FIG. 19 showing the removed fitment 200 hanging from the dish basket 201 in a dishwasher 202, or via hanger tabs 203 connected to the fitment and tied or otherwise attached to the basket by the user. The fitment may for example contain nonionic surfactant in addition to the normal amount of non-ionic in the detergent phase added to the dishwasher dispenser indicated at 204. See, for example, the following formula:

AUTODISH DETERGENTS WITH FITMENTS AS RINSE AIDS

| | |
|---|---|
| Detergent Phase | |
| Chlorinated trisodiumphosphate % | 28.0 |
| Sodium tripolyphosphate | 39.3 |
| Nonionic | 2.5 |
| Sodium silicate, liquid | 30.2 |
| Fitment Phase | |
| Flaked nonionic with a high melting point fatty amide and/or wax melted together to make a solid fitment to be hung in the dishwasher. | |

The nonionic in the fitment may alternatively have liquid form, and may be placed or poured into dishwasher dispenser 204 at the time of dishwasher use.

The fitment 200 may include a porous dispensing container (as for example a net) with hanger tabs 203 attached, and sized to fit in the bottle neck 10*a*. When tab-attached to the dishwasher basket, porous container exposes the fitment contents to the dishwasher spray.

It will also be understood that the bottle, as at 10 and/or 10*a*, may have a transparent (glass, plastic, etc.) side wall, and that the fitment dispensing container (as for example at 16) may extend within the bottle to an extent such that the dispensing container and the contents of bottle 16 can be seen sidewardly through the bottle side wall. In this regard, the dispensing container may also have a transparent (glass, plastic, etc.) side wall (16*a*, for example) whereby the composition in the dispensing container can also be seen through both such transparent side walls.

We claim:

1. In the method of washing articles in an automatic dishwasher, having a foodware supporting basket exposed to aqueous spray, the steps that include:

(a) providing a first volume of a first treating component for use in the dishwasher, (b) providing a second volume of a second treating component in close transported association with the first volume, but isolated therefrom, for presentation at the time of use of said first component, for dishwashing, (c) one of said first and second components consisting essentially of nonionic surfactant, and the other of said first and second components consisting essentially of chlorine release agent, and (d) separating some of said second component from said close association with the first component and employing same in the dishwasher separately from said first component and exposing to said spray in proximity to said basket during dishwashing, (e) said first volume of first treating component being provided in a relatively large container, provided with a neck, (f) said second volume of second treating component being provided in a fitment substantially smaller than said relatively large container including a porous dispensing container, (g) said (b) step including locating the fitment in the relatively large container, via said neck, (h) gaining access to the fitment in the large container and via said neck so that said second treating component may be employed in the dishwasher, and at the time of also gaining access to the first treating component in the large container via said neck prior to said step (d) employment of the second component in the dishwasher (i) and adding said first and second components to the dishwasher, initiating automatic operation thereof to wash articles using said components, and exposing said porous dispensing container to said spray.

2. The method of claim 1 wherein the second component is associated with said basket, to distribute said second component in said spray.

3. The method of claim 2 wherein said second component consists essentially of nonionic surfactant.

4. The method of claim 1 wherein said chlorine release agent is selected from the group consisting essentially of:

($x_1$) chlorinated trisodium phosphate, ($x_2$) sodium dichlorocyanurate (or hydrated form thereof), ($x_3$) potassium dichlorocyanurate, ($x_4$) trichloroisocyanuric acid, ($x_5$) 1,3 dichloro 5,5 dimethylhydantoin, ($x_6$) N,N'-dichlorobenzoylene urea, ($x_7$) N-dichloro binuret, ($x_8$) sodium hypochlorite, ($x_9$) calcium hypochlorite, ($x_{10}$) lithium hypochlorite.

5. The method of claim 1 wherein the nonionic surfactant is selected from the group consisting essentially of a. The condensation of 1 mole of a saturated or unsaturated, straight, or branched chain, alcohol or fatty acid containing about 10–20 carbon atoms with from about 4 to 50 moles of ethylene oxide;

b. Polyethylene glycols having a molecular weight of about 1,400 to 30,000;

c. The condensation of mole of alkylphenol (8–18 carbons in alkyl chain) with from 4 to 50 moles of ethylene oxide;

d. Polyoxypropylene, polyoxyethylene condensates;

e. Compounds like (a) that are "capped" with propylene oxide, butylene oxide and/or short chain alcohols and/or fatty acids (carbon chains of 1–5).

6. The method of claim 1 wherein the fitment has hanger means attached thereto, and said employment of the second component includes attaching said hanger means to the dishwasher basket.

7. The method of claim 1 wherein an amount of said chlorine release agent is employed to provide a use level between 0.5% and 3.0% by weight as available chlorine.

8. The method of claim 1 wherein the first component includes a detergent composition which includes one or more of the following:

($x_1$) Sodium silicate ($x_2$) builder selected from the group consisting essentially of potassium tripolyphosphate, sodium tripolyphosphate, pyrophosphate, orthophosphate, sodium carbonate, organopolycarboxylate, and chlorinated trisodiumphosphate ($x_3$) filler selected from the group consisting essentially of sodium chloride, potassium chloride, sodium sulfate, potassium sulfate, sucrose, and sucrose esters.

* * * * *